US012065803B2

(12) United States Patent
Tanaka et al.

(10) Patent No.: US 12,065,803 B2
(45) Date of Patent: Aug. 20, 2024

(54) COMPACTION CONTROL OF WORK MACHINE

(71) Applicant: HITACHI CONSTRUCTION MACHINERY CO., LTD., Tokyo (JP)

(72) Inventors: Hiroaki Tanaka, Kasumigaura (JP); Hisami Nakano, Tsuchiura (JP); Takaaki Chiba, Kasumigaura (JP); Yuusuke Suzuki, Tsuchiura (JP); Hiroshi Sakamoto, Hitachi (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 198 days.

(21) Appl. No.: 16/491,220

(22) PCT Filed: Apr. 25, 2018

(86) PCT No.: PCT/JP2018/016876
§ 371 (c)(1),
(2) Date: Sep. 5, 2019

(87) PCT Pub. No.: WO2019/064665
PCT Pub. Date: Apr. 4, 2019

(65) Prior Publication Data

US 2019/0390436 A1 Dec. 26, 2019

(30) Foreign Application Priority Data

Sep. 26, 2017 (JP) ..... 2017-184547

(51) Int. Cl.
*E02F 3/43* (2006.01)
*E02F 3/32* (2006.01)
(Continued)

(52) U.S. Cl.
CPC ..... *E02F 3/435* (2013.01); *E02F 9/2004* (2013.01); *E02F 9/2033* (2013.01); *E02F 9/262* (2013.01); *E02F 3/32* (2013.01)

(58) Field of Classification Search
CPC ... E02F 3/435; E02F 3/32; E02F 3/437; E02F 9/2203; E02F 9/2271; E02F 9/26; E02F 9/2004; E02F 9/2033; E02F 9/262
(Continued)

(56) References Cited

U.S. PATENT DOCUMENTS 5,826,666 A 10/1998 Tozawa et al.
5,968,104 A * 10/1999 Egawa ..... E02F 9/2285 701/50
(Continued)

FOREIGN PATENT DOCUMENTS

DE 102015006398 B3 * 5/2016 ..... E01C 19/288
JP 07-190004 A 7/1995
(Continued)

OTHER PUBLICATIONS

Antrag auf Nichtnennung, Espacenet, 2016, https://worldwide.espacenet.com/publicationDetails/biblio?CC=DE&NR=102015006398B3&KC=B3&FT=D&ND=3&date=20160504&DB=EPODOC&locale=en_EP (Year: 2016).*
(Continued)

*Primary Examiner* — Thomas E Worden
*Assistant Examiner* — Sean Patrick Reidy
(74) *Attorney, Agent, or Firm* — MATTINGLY & MALUR, PC

(57) ABSTRACT

A work machine includes a controller that executes a semi-automatic control to correct an operation amount indicated by an instruction given by operation devices. The controller is configured to make a compaction determination to determine whether or not a bottom surface of a bucket is being
(Continued)

pressed against a ground; and to further correct an operation amount having been corrected by the semi-automatic control, such that a force that the bucket applies to the ground increases if the bottom surface of the bucket is determined as being pressed against the ground.

3 Claims, 11 Drawing Sheets

(51) Int. Cl.
*E02F 9/20* (2006.01)
*E02F 9/26* (2006.01)

(58) Field of Classification Search
USPC ..... 701/50
See application file for complete search history.

(56) References Cited

U.S. PATENT DOCUMENTS

| | | | | |
|---|---|---|---|---|
| 9,926,677 | B1 * | 3/2018 | Beckhusen | E02D 3/046 |
| 10,364,546 | B2 * | 7/2019 | Shimano | E02F 3/967 |
| 2011/0318155 | A1 | 12/2011 | Okamura et al. | |
| 2015/0176254 | A1 * | 6/2015 | Blakeman | E02F 9/264 701/50 |
| 2015/0308081 | A1 * | 10/2015 | Takaura | E02F 9/262 701/50 |
| 2016/0010311 | A1 * | 1/2016 | Paull | E02F 3/437 701/50 |
| 2017/0101761 | A1 * | 4/2017 | Wu | E02F 9/2235 |
| 2017/0241097 | A1 * | 8/2017 | Sharp | E01C 19/34 |

FOREIGN PATENT DOCUMENTS

| | | | |
|---|---|---|---|
| JP | 09-228404 | A | 9/1997 |
| JP | 11-210514 | A | 8/1999 |
| JP | 2014-43682 | A | 3/2014 |
| WO | 2016/129708 | A1 | 8/2016 |

OTHER PUBLICATIONS

International Preliminary Report on Patentability received in corresponding International Application No. PCT/JP2018/016876 dated Apr. 9, 2020.

International Search Report of PCT/JP2018/016876 dated Jun. 12, 2018.

* cited by examiner

COMPACTION CONTROL OF WORK MACHINE

TECHNICAL FIELD

The present invention relates to a work machine such as a hydraulic excavator.

BACKGROUND ART

Work machines such as hydraulic excavators include a work implement having a work tool such as a bucket. The work implement is driven by a hydraulic actuator. The hydraulic actuator is driven by hydraulic fluid supplied from a hydraulic pump. The hydraulic fluid supplied from the hydraulic pump to the hydraulic actuator is controlled by a directional control valve. The directional control valve is operated by a pilot pressure generated at a hydraulic pilot-type operation device, for example. The operation device has an operation lever, and generates a pilot pressure according to the operation direction, and operation amount of the operation lever. An operator can give an instruction to the work machine about the action direction, and action velocity of the hydraulic actuator by operating the operation lever.

By the way, there are hydraulic excavators equipped with semi-automatic control for assisting operation by an operator in works to excavate the ground to form a surface as designed. Such hydraulic excavators equipped with semi-automatic control are disclosed for example in Patent Document 1.

Patent Document 1 discloses an apparatus that controls a work implement provided to a work machine for construction of an object to undergo construction, the work machine controller including: a control section that controls the work implement such that a work tool provided to the work implement does not penetrate a predetermined target shape; and a switching section that, based on a posture of the work tool relative to a target construction topography which is a target shape to be attained after finishing of the object to undergo construction, sets the target shape to the target construction topography or an offset topography which is offset from the target construction topography by a predetermined distance (claim 1).

PRIOR ART DOCUMENT

Patent Document

Patent Document 1: WO2016/129708

SUMMARY OF THE INVENTION

Problems to be Solved by the Invention

As one type of work to be performed by a hydraulic excavator, there are slope face forming works. Slope face forming works are classified into: works to excavate the ground leaving a pressing allowance (a compaction allowance) unexcavated; and works to compact the excavated surface (compaction works). Compaction works include: leveling works in which a bucket is moved along the ground while the bucket bottom surface is being pressed against the ground; and bumping works in which the bucket bottom surface is bumped against the ground.

According to the work machine described in Patent Document 1, operator's operation in works to excavate the ground to form a surface as designed can be assisted by setting the target shape to a target construction topography (a design surface). In addition, operator's operation in works to excavate the ground while leaving a pressing allowance (a compaction allowance) unexcavated can be assisted by setting the target shape to an offset topography which is offset from a target construction topography (a design surface) by a predetermined distance.

However, in the work machine described in Patent Document 1, when the target shape is set to a target construction topography (a design surface), the force to press the bucket against the ground lowers as the bucket approaches the design surface, and so it is not possible to compact the ground to form a surface as designed. In addition, when the target shape is set to a negatively offset topography which is offset downward from the design surface by a certain distance, the force to press the bucket against the ground at the position of the design surface can be surely maintained, but there is a fear that the bucket might penetrate down the design surface. In this manner, the work machine described in Patent Document 1 cannot assist operator's operation in compaction works to compact the ground to form a surface as designed.

The present invention has been made in view of the problems explained above, and an object thereof is to provide a work machine equipped with semi-automatic control for assisting operator's operation in works to excavate the ground to form a surface as designed, which work machine can assist operator's operation in compaction works to compact the ground to form a surface as designed.

Means for Solving the Problems

In order to achieve the object explained above, the present invention provides a work machine including: a work implement having a work tool; a plurality of hydraulic actuators that drive the work implement; an operation device that gives an instruction about an operation amount of the plurality of hydraulic actuators; and a controller having a semi-automatic control section that corrects the operation amount indicated by the instruction given by the operation device, such that the work tool does not move down below a predetermined design surface, in which the controller has: a compaction determining section that determines whether or not the work tool is being pressed against a ground; and an actuator control correcting section that further corrects an operation amount having been corrected by the semi-automatic control section, such that a force that the work tool applies to the ground increases if the work tool is determined by the compaction determining section as being pressed against the ground.

According to the thus-configured present invention, when the bucket bottom surface is not being pressed against the ground, the operation amount instructed by the operation device is corrected by the semi-automatic control section such that the bucket does not penetrate down the predetermined design surface. On the other hand, when the bucket bottom surface is being pressed against the ground, the operation amount having been corrected by the semi-automatic control section is further corrected such that the force to press the bucket bottom surface against the ground increases. Thus, it becomes possible to assist operator's operation in works to excavate the ground to form a surface as designed, and additionally to assist operator's operation in compaction works to compact the ground to form a surface as designed.

Advantages of the Invention

According to the present invention, with a work machine equipped with semi-automatic control for assisting operator's operation in works to excavate the ground to form a surface as designed, it becomes possible to assist operator's operation in compaction works to compact the ground to form a surface as designed.

MODES FOR CARRYING OUT THE INVENTION

Figure 1:
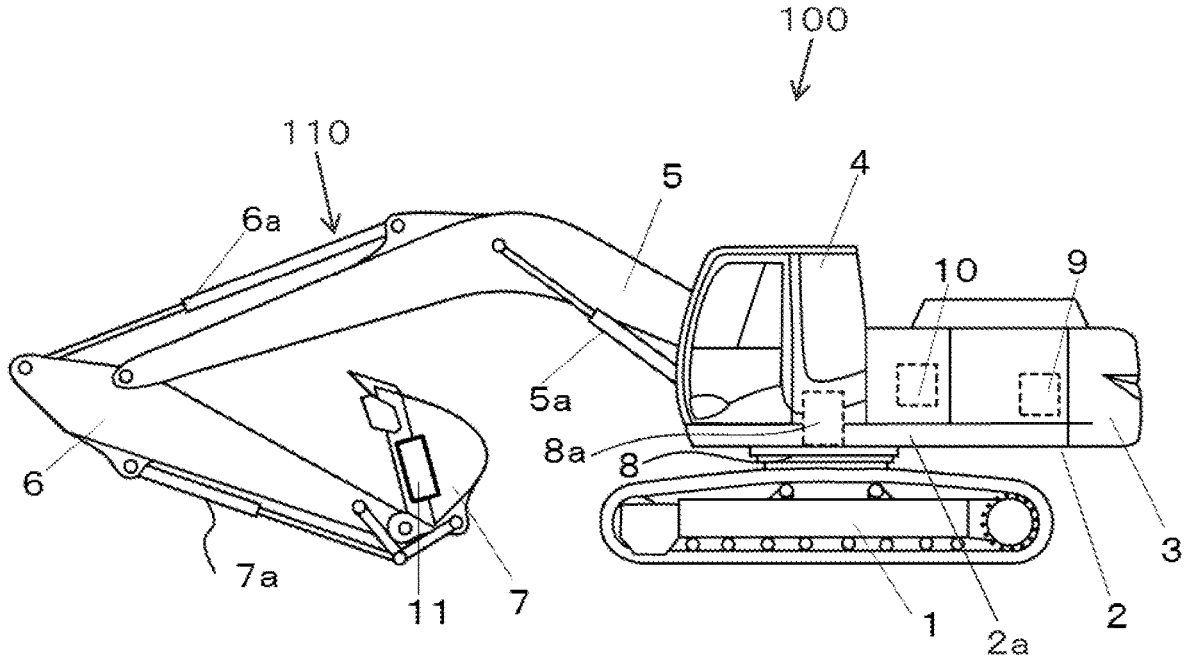
FIG. 1 is a side view of a hydraulic excavator according to a first embodiment of the present invention.

Hereinafter, a hydraulic excavator is explained as an example of a work machine according to an embodiment of the present invention with reference to the drawings. Note that in the individual drawings, equivalent members are given identical reference characters, and duplicate explanations are omitted as appropriate.

First Embodiment

FIG. 1 is a side view of a hydraulic excavator according to a first embodiment of the present invention. As illustrated in FIG. 1, a hydraulic excavator 100 includes: a track structure 1; a swing structure 2 mounted on the track structure 1 so as to be swingable via a swing device 8; and a front work implement 110 coupled to a front portion of the swing structure 2 so as to be pivotable upward/downward.

The swing structure 2 has a swing frame 2*a* constituting a base lower structure. The front work implement 110 is coupled to a front side of the swing frame 2*a* so as to be pivotable upward/downward. A counter weight 3 for counterbalancing the weight with the front work implement 110 is attached to a rear side of the swing frame 2*a*. A front left portion of the swing frame 2*a* is provided with a cab 4. Left and right operation lever devices 15L and 15R (illustrated in FIG. 2) as operation devices for operating the front work implement 110 and swing structure 2 are arranged in the cab 4. An engine (not illustrated) as a prime mover; a pump device 9 consisting of one or more hydraulic pumps driven by the engine; a swing motor 8*a* that swing-drives the swing structure 2 (swing frame 2*a*) relative to the track structure 1; a control valve unit 10 including a plurality of directional control valves that control flow of hydraulic fluid supplied from the pump device 9 to the swing motor 8*a* and a plurality of hydraulic actuators including a boom cylinder 5*a*, an arm cylinder 6*a*, and a bucket cylinder 7*a* mentioned below; and the like are mounted on the swing frame 2*a*.

The front work implement 110 includes: a boom 5 having a base end portion that is coupled to a front right portion of the swing frame 2*a* so as to be pivotable upward/downward; an arm 6 that is coupled to a tip portion of the boom 5 so as to be pivotable upward/downward and forward/backward, and is raised and lowered by the boom 5; a bucket 7 as a work tool that is coupled to a tip portion of the arm 6 so as to be pivotable upward/downward and forward/backward, and is raised and lowered by the boom 5 or arm 6; the boom cylinder 5*a* that drives the boom 5; the arm cylinder 6*a* that drives the arm 6; and the bucket cylinder 7*a* that drives the bucket 7. The bucket 7 is provided with a bucket position measurement system 11. Note that in FIG. 1, the bucket position measurement system 11 is illustrated as a system that measures the bucket claw tip position directly, but it may be a system that calculates the bucket position from the positional relations between the swing structure 2, boom 5, arm 6 and bucket 7.

Figure 2:
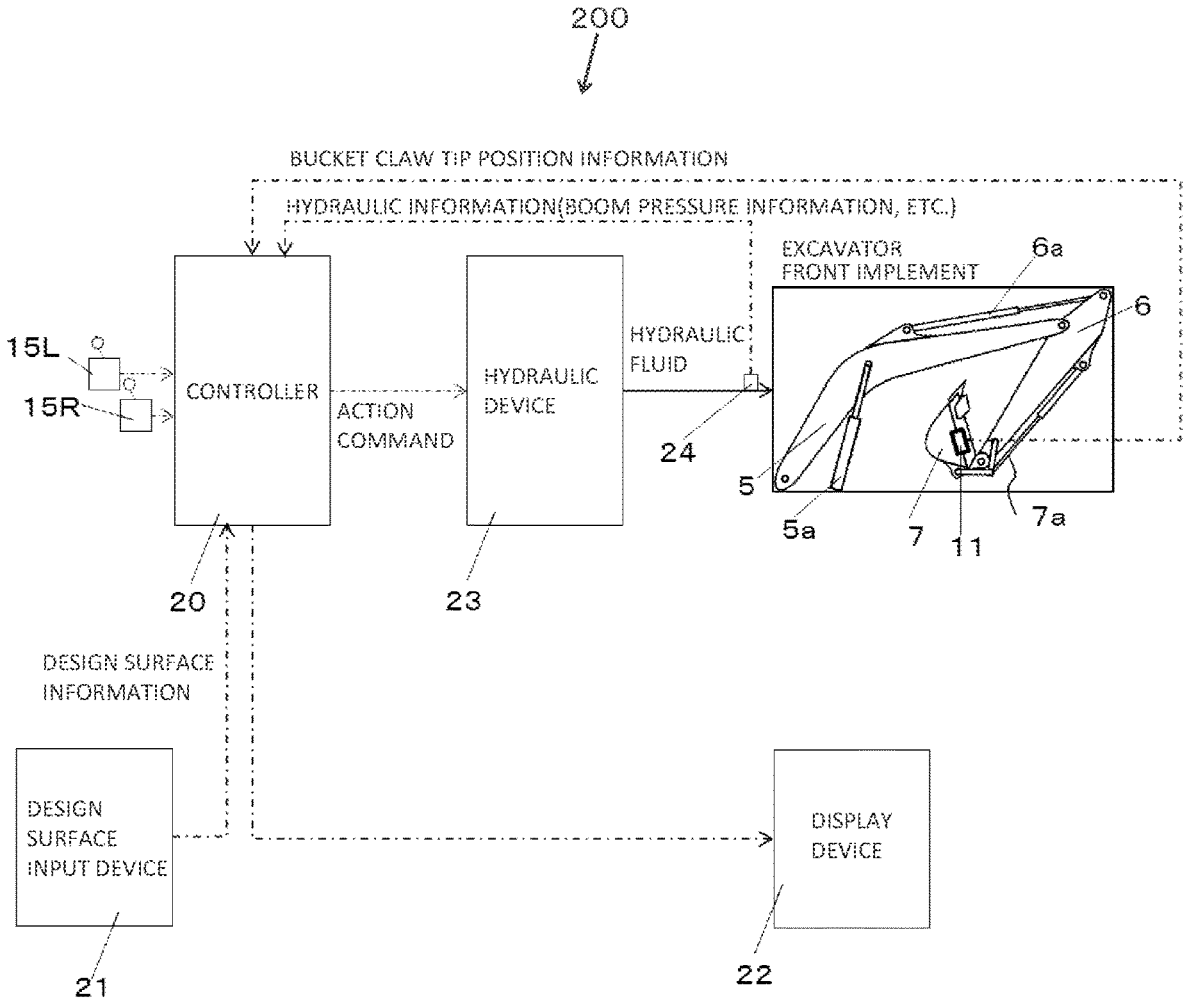
FIG. 2 is a schematic configurational diagram of a hydraulic control system mounted on the hydraulic excavator according to the first embodiment of the present invention.

FIG. 2 is a schematic configurational diagram of a hydraulic control system mounted on the hydraulic excavator 100. As illustrated in FIG. 2, a hydraulic control system 200 includes: a controller 20; a design surface input device 21 for inputting preset design surface information to the controller 20; a display device 22 for displaying information output from the controller 20; the left and right operation lever devices 15L and 15R for giving instructions to the controller 20 about action of the hydraulic excavator 100; the bucket position measurement system 11; a pressure sensor 24; and a hydraulic device 23.

The left and right operation lever devices 15L and 15R output operation signals according to lever operation by an operator. The pressure sensor 24 converts, into a pressure signal, the load pressure of the boom cylinder 5*a*, that is, the pressure (boom pressure) of a hydraulic operating fluid supplied from the pump device 9 (illustrated in FIG. 1) to a bottom side oil chamber or rod side oil chamber of the boom cylinder 5*a*, and outputs the pressure signal.

The controller 20 outputs an action command to the hydraulic device 23 according to: operation signals from the left and right operation lever devices 15L and 15R; design surface information from the design surface input device 21; bucket claw tip position information from the bucket position measurement system 11; and a pressure signal (boom pressure information) from the pressure sensor 24.

According to an action command from the controller 20, the hydraulic device 23 supplies hydraulic fluids to the boom cylinder 5*a*, arm cylinder 6*a*, bucket cylinder 7*a* and the like to drive the boom 5, arm 6, bucket 7 and the like.

Figure 3:
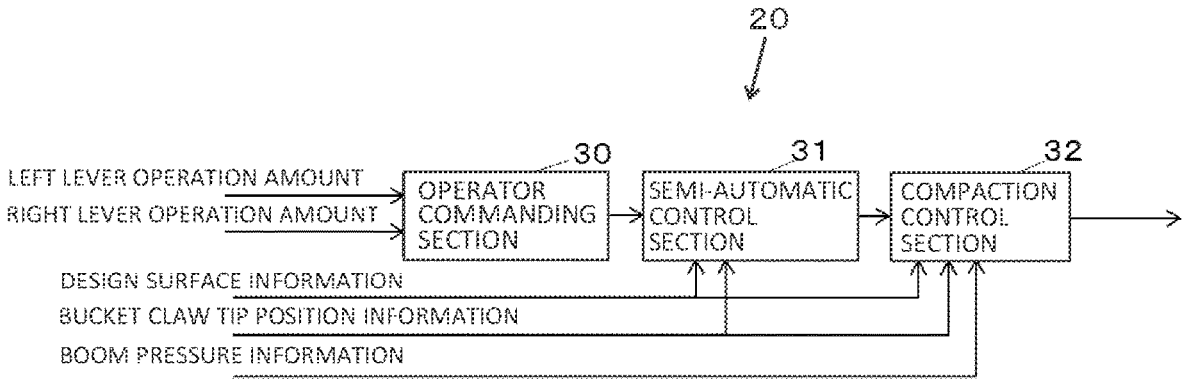
FIG. 3 is a functional block diagram of a controller according to the first embodiment of the present invention.

FIG. 3 is a functional block diagram of the controller 20. As illustrated in FIG. 3, the controller 20 includes an operator commanding section 30, a semi-automatic control section 31, and a compaction control section 32.

Based on operation signals (left and right lever operation amounts) from the left and right operation lever devices 15L and 15R, the operator commanding section 30 decides a target action velocity of an actuator, and outputs an action command according to the target action velocity. The semi-automatic control section 31 corrects the action command output from the operator commanding section 30 such that the degree of restriction of the target action velocity of the actuator increases as the deviation between a design surface and the bucket claw tip position decreases, in order to prevent excessive excavation by the bucket 7. The compaction control section 32 corrects the action command output from the semi-automatic control section 31, based on the design surface information, bucket claw tip position information, and boom pressure information. The thus-configured controller 20 can execute semi-automatic control to assist operator's operation in works to excavate the ground to form a surface as designed, and additionally can execute compaction control to assist operator's operation in compaction works to compact the ground to form a surface as designed.

Figure 4:
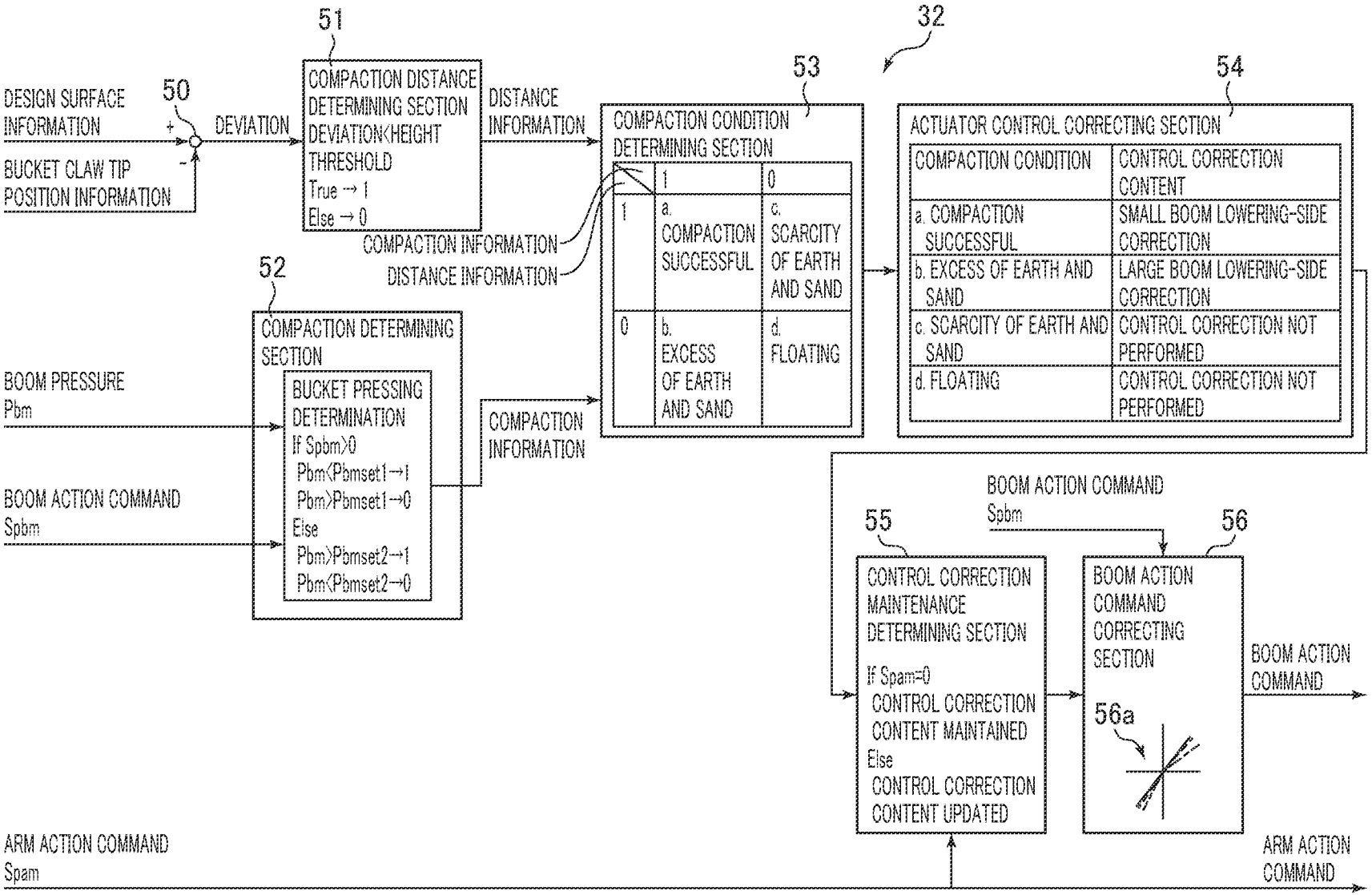
FIG. 4 is a functional block diagram of a compaction control section according to the first embodiment of the present invention.

FIG. 4 is a functional block diagram of the compaction control section 32. As illustrated in FIG. 4, the compaction control section 32 includes an adding/subtracting section 50, a compaction distance determining section 51, a compaction determining section 52, a compaction condition determining section 53, an actuator control correcting section 54, a control correction maintenance determining section 55, and a boom action command correcting section 56.

The adding/subtracting section 50 calculates the deviation between a design surface and the bucket claw tip position, and outputs the deviation to the compaction distance determining section 51.

Based on the deviation from the adding/subtracting section 50, the compaction distance determining section 51 determines a compaction distance, and outputs a result of the determination to the compaction condition determining section 53 as distance information. Specifically, if the deviation input from the adding/subtracting section 50 is smaller than a predetermined height threshold, the compaction distance determining section 51 outputs 1 as the distance information, and if not, outputs 0 as the distance information.

Based on a boom pressure Pbm and a boom action command Spbm, the compaction determining section 52 determines whether or not the bucket bottom surface is being pressed against the ground (bucket pressing determination), and outputs a result of the determination to the compaction condition determining section 53 as compaction information. Specifically, if the boom action command Spbm is positive (boom raising action), and the boom pressure Pbm is lower than a pressure threshold Pbmset1 (the boom raising load decreases as compared to that at the time of excavation due to a ground reaction force that is applied via the bucket 7), the compaction determining section 52 determines that the bucket bottom surface is being pressed against the ground, and outputs 1 as the compaction information. On the other hand, if the boom action command Spbm is positive (boom raising action), and the boom pressure Pbm is higher than the pressure threshold Pbmset1, the compaction determining section 52 determines that the bucket bottom surface is not being pressed against the ground, and outputs 0 as the compaction information. In addition, if the boom action command is negative (boom lowering action), and the boom pressure Pbm is higher than a pressure threshold Pbmset2 (the boom lowering load increases as compared to that at the time of excavation due to a ground reaction force that is applied via the bucket 7), the compaction determining section 52 determines that the bucket bottom surface is being pressed against the ground, and outputs 1 as the compaction information. On the other hand, if the boom action command Spbm is negative (boom lowering action), and the boom pressure Pbm is lower than the pressure threshold Pbmset2, the compaction determining section 52 determines that the bucket bottom surface is not being pressed against the ground, and outputs 0 as the compaction information. Different pressure thresholds and different determination methods are used according to whether the boom action command Spbm is positive or negative because to which side of the boom cylinder 5*a*, the larger diameter side (bottom side oil chamber) or the smaller diameter side (rod side oil chamber), a hydraulic operating fluid is supplied, and how the influence of a ground reaction force manifests itself in the boom pressure Pbm depend on the boom action direction. Note that the compaction determining section 52 according to the present embodiment determines, based only on the boom pressure Pbm, whether or not the bucket 7 is being pressed against the ground, but it may determine whether or not the bucket 7 is being pressed against the ground by additionally taking into consideration the arm pressure or bucket pressure.

The compaction condition determining section 53 determines a compaction condition based on the distance information from the compaction distance determining section 51 and the compaction information from the compaction determining section 52, and outputs a result of the determination to the actuator control correcting section 54. Specifically, if the compaction information is 1, and the distance information is 1 (the bucket bottom surface is being pressed against the ground while the bucket claw tip position is close to the design surface), it is determined that compaction is being performed successfully ("a. Compaction Successful"); if the compaction information is 1, and the distance information is 0 (the bucket claw tip position is away from the design surface, and the bucket bottom surface is being pressed against the ground), it is determined that compaction cannot be performed near the design surface due to an excess of earth and sand ("b. Excess of Earth and Sand"); if the compaction information is 0, and the distance information is 1 (the bucket claw tip position is close to the design surface, and the bucket is not being pressed against the ground), it is determined that compaction cannot be performed near the design surface due to a scarcity of earth and sand ("c. Scarcity of Earth and Sand"); and if the compaction information is 0, and the distance information is 0 (the bucket claw tip position is away from the design surface, and the bucket bottom surface is not being pressed against the ground), it is determined that the bucket 7 is simply floating ("d. Floating").

Based on the compaction condition from the compaction condition determining section 53, the actuator control correcting section 54 decides a control correction content, and outputs the control correction content to the control correction maintenance determining section 55. Specifically, if the compaction condition is "a. Compaction Successful," compaction is being performed successfully near the design surface, but the bucket 7 is pushed up by a ground reaction force; therefore, correction is desirably performed to reduce the degree of rising of the boom 5 a little or increase the degree of lowering of the boom 5 a little in order to surely press the bucket 7 against the ground. Accordingly, a control correction content that the boom action command is corrected a little toward the boom lowering-side (small boom lowering-side correction) is output. If the compaction condition is "b. Excess of Earth and Sand," the bucket bottom surface is being pressed against the ground while the bucket claw tip position is away from the design surface; therefore, correction is desirably performed to reduce the degree of rising of the boom 5 or increase the degree of lowering of the boom 5 in order to press the bucket 7 against the ground harder. Accordingly, a control correction content that the boom action command is corrected a lot toward the boom lowering-side (large boom lowering-side correction) is output. If the compaction condition is "c. Scarcity of Earth and Sand," compaction cannot be performed due to a scarcity of earth and sand on the ground; therefore, control correction is not performed, but excessive excavation preventive control by the semi-automatic control section 31 is prioritized. If the compaction condition is "d. Floating" also, control correction is not performed, but excessive excavation preventive control by the semi-automatic control section 31 is prioritized.

According to the arm action command Spam, the control correction maintenance determining section 55 maintains or updates the control correction content from the actuator control correcting section 54, and outputs the control correction content to the boom action command correcting section 56. Specifically, if the arm action command Spam is 0 (it is expected that the arm 6 is not to be in action, and the position at which the bucket 7 contacts the ground does not change), the control correction content from the actuator control correcting section 54 is output with its content being maintained. On the other hand, if the arm action command Spam is not 0 (it is expected that the arm 6 is to be in action, and the position at which the bucket 7 contacts the ground changes), the control correction content from the actuator control correcting section 54 is output while being updated. By doing so, even when the bucket 7 is moved away from the ground, the boom lowering-side correction is kept effective in bumping works to perform compaction by hitting the same portion with the bucket 7; therefore, it becomes easy to perform the second and subsequent bumping works. In addition, in leveling works in which the position of the bucket 7 is adjusted by means of the boom 5 and arm 6, and the bucket 7 is moved while being pressed against the ground, the control correction content is updated successively according to the compaction condition; therefore, control according to the situation of the ground becomes possible, and it becomes easy to perform compaction works.

Figure 5:
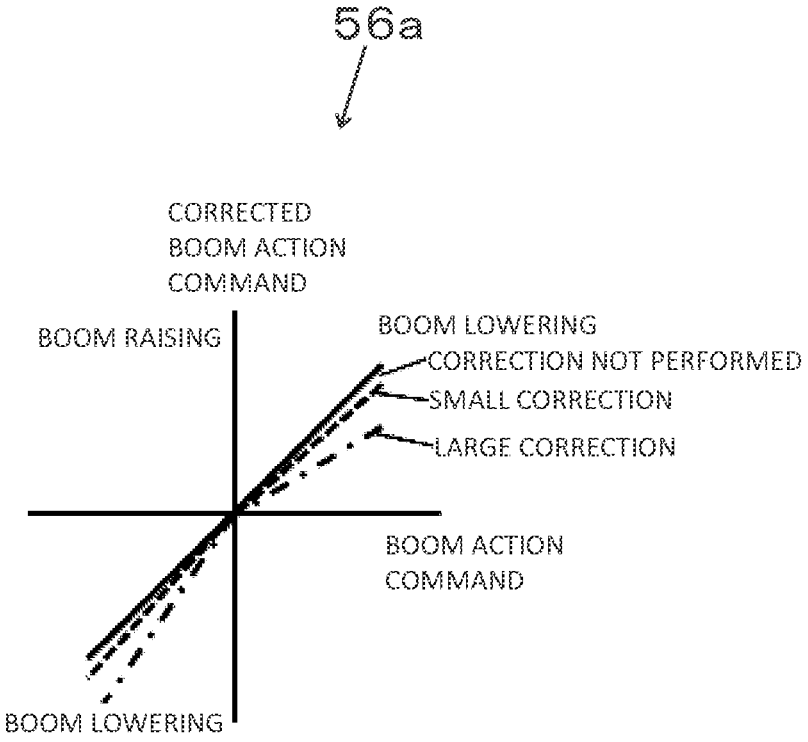
FIG. 5 is a drawing illustrating a boom action command conversion table referred to by a boom action command correcting section according to the first embodiment of the present invention.

The boom action command correcting section 56 refers to a boom action command conversion table 56*a* which is illustrated in FIG. 5 as an enlarged view, and corrects the boom action command from the semi-automatic control section 31 according to the control correction content from the control correction maintenance determining section 55. Specifically, in the case of no control correction, the boom action command, and the corrected boom action command are related to each other at the ratio of 1:1 as indicated by the solid line in FIG. 5. In the case of small boom lowering-side correction, the boom action command is corrected as indicated by the dotted line in FIG. 5 such that the ratio of the corrected boom action command to the boom action command of the boom raising-side becomes slightly lower than 1, and also the ratio of the corrected boom action command to the boom action command of the boom lowering-side becomes slightly higher than 1. In the case of large boom lowering-side correction, the boom action command is corrected as indicated by the dash-dotted line in FIG. 5 such that the ratio of the corrected boom action command to the boom action command of the boom raising-side becomes lower than 1, and also the ratio of the corrected boom action command to the boom action command of the boom lowering-side becomes higher than 1. By doing so, it becomes possible to press the bucket 7 against the ground according to the compaction condition, on the basis of the excessive excavation preventive action by the semi-automatic control section 31. Note that the arm action command Spam input from the semi-automatic control section 31 is output directly to the hydraulic device 23 (illustrated in FIG. 2) without being corrected by the compaction control section 32.

Figure 6:
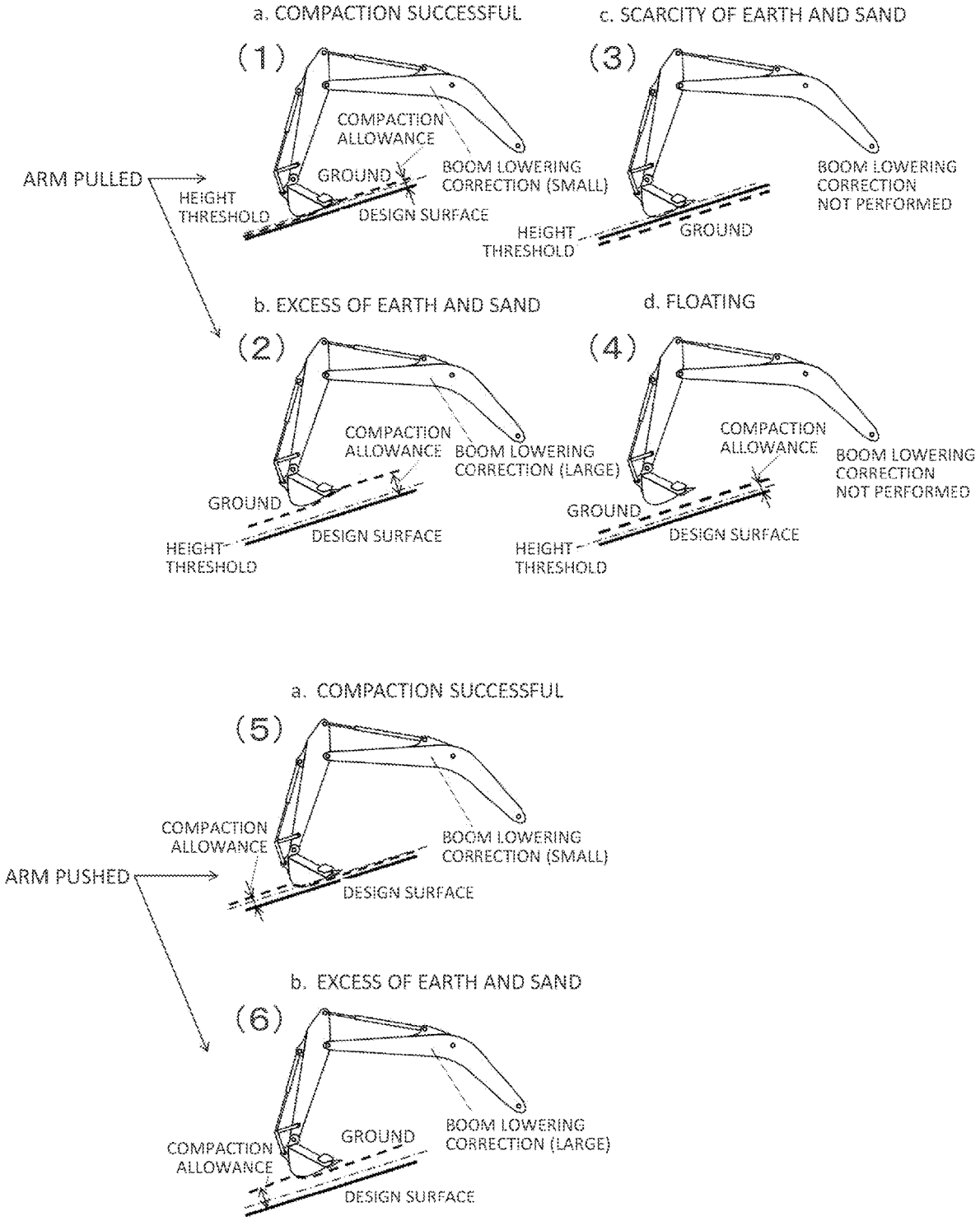
FIG. 6 is a drawing illustrating action of a front work implement at the time of compaction works according to the first embodiment of the present invention.

FIG. 6 is a drawing illustrating action of the front work implement 110 at the time of compaction works according to the present embodiment.

As illustrated in (1) of FIG. 6, when the deviation between the bucket claw tip position and the design surface is smaller than the height threshold, and arm-pulling action is being performed while the bucket bottom surface is being pressed against the ground, the compaction condition is determined as "a. Compaction Successful," and the boom action command is corrected a little toward the boom lowering-side; therefore, the force to press the bucket bottom surface against the ground increases a little in leveling works by arm-pulling action, on the basis of the excessive excavation preventive action by the semi-automatic control section 31.

As illustrated in (2) of FIG. 6, when the deviation between the bucket claw tip position and the design surface is larger than the height threshold, and arm-pulling action is being performed while the bucket bottom surface is being pressed against the ground, the compaction condition is determined as "b. Excess of Earth and Sand," and the boom action command is corrected a lot toward the boom lowering-side; therefore, the force to press the bucket bottom surface against the ground increases a lot, on the basis of the excessive excavation preventive action by the semi-automatic control section 31.

As illustrated in (3) of FIG. 6, when the deviation between the bucket claw tip position and the design surface is smaller than the height threshold, and the bucket bottom surface is not being pressed against the ground, the compaction condition is determined as "c. Scarcity of Earth and Sand," and the boom action command is not corrected toward the boom lowering-side; therefore, excessive excavation preventive action by the semi-automatic control section 31 is prioritized.

As illustrated in (4) of FIG. 6, when the deviation between the bucket claw tip position and the design surface is larger than the height threshold, and the bucket bottom surface is not being pressed against the ground, the compaction condition is determined as "d. Floating," and the boom action command is not corrected toward the boom lowering-side; therefore, excessive excavation preventive action by the semi-automatic control section 31 is prioritized.

As illustrated in (5) of FIG. 6, when the deviation between the bucket claw tip position and the design surface is smaller than the height threshold, and arm-pushing action is being performed while the bucket bottom surface is being pressed against the ground, the compaction condition is determined as "a. Compaction Successful," and the boom action command is corrected a little toward the boom lowering-side; therefore, the force to press the bucket bottom surface against the ground increases a little, on the basis of the excessive excavation preventive action by the semi-automatic control section 31.

As illustrated in (6) of FIG. 6, when the deviation between the bucket claw tip and the ground is larger than the height threshold, and arm-pushing action is being performed while the bucket bottom surface is being pressed against the ground, the compaction condition is determined as "b. Excess of Earth and Sand," and the boom action command is corrected a lot toward the boom lowering-side; therefore, the force to press the bucket bottom surface against the ground increases a lot, on the basis of the excessive excavation preventive action by the semi-automatic control section 31.

With the hydraulic excavator 100 according to the thus-configured present embodiment, when the bucket bottom surface is not being pressed against the ground, the lever operation amount is corrected by the semi-automatic control section 31 such that the bucket 7 does not penetrate down the design surface. On the other hand, when the bucket bottom surface is being pressed against the ground while the bucket tip is close to the design surface, the boom action command having been corrected by the semi-automatic control section 31 is corrected a little toward the boom lowering-side such that the force to press the bucket bottom surface against the ground increases a little. In addition, when the bucket bottom surface is being pressed against the ground while the bucket tip is away from the design surface, the boom action command having been corrected by the semi-automatic control section 31 is corrected a lot toward the boom lowering-side such that the force to press the bucket bottom surface against the ground increases a lot. Thereby, it becomes possible to assist operator's operation in works to excavate the ground to form a surface as designed, and additionally to assist operator's operation in compaction works to compact the ground to form a surface as designed.

In addition, if it is expected that the arm 6 is not to be in action, and that the position at which the bucket 7 contacts the ground does not change, the control correction content based on the compaction condition is maintained even though the bucket 7 is moved away from the ground; therefore, it is possible to efficiently assist operator's operation in bumping works to perform compaction by hitting the same portion with the bucket 7.

Second Embodiment

A hydraulic excavator according to a second embodiment of the present invention are explained focusing on differences from the first embodiment.

Figure 7:
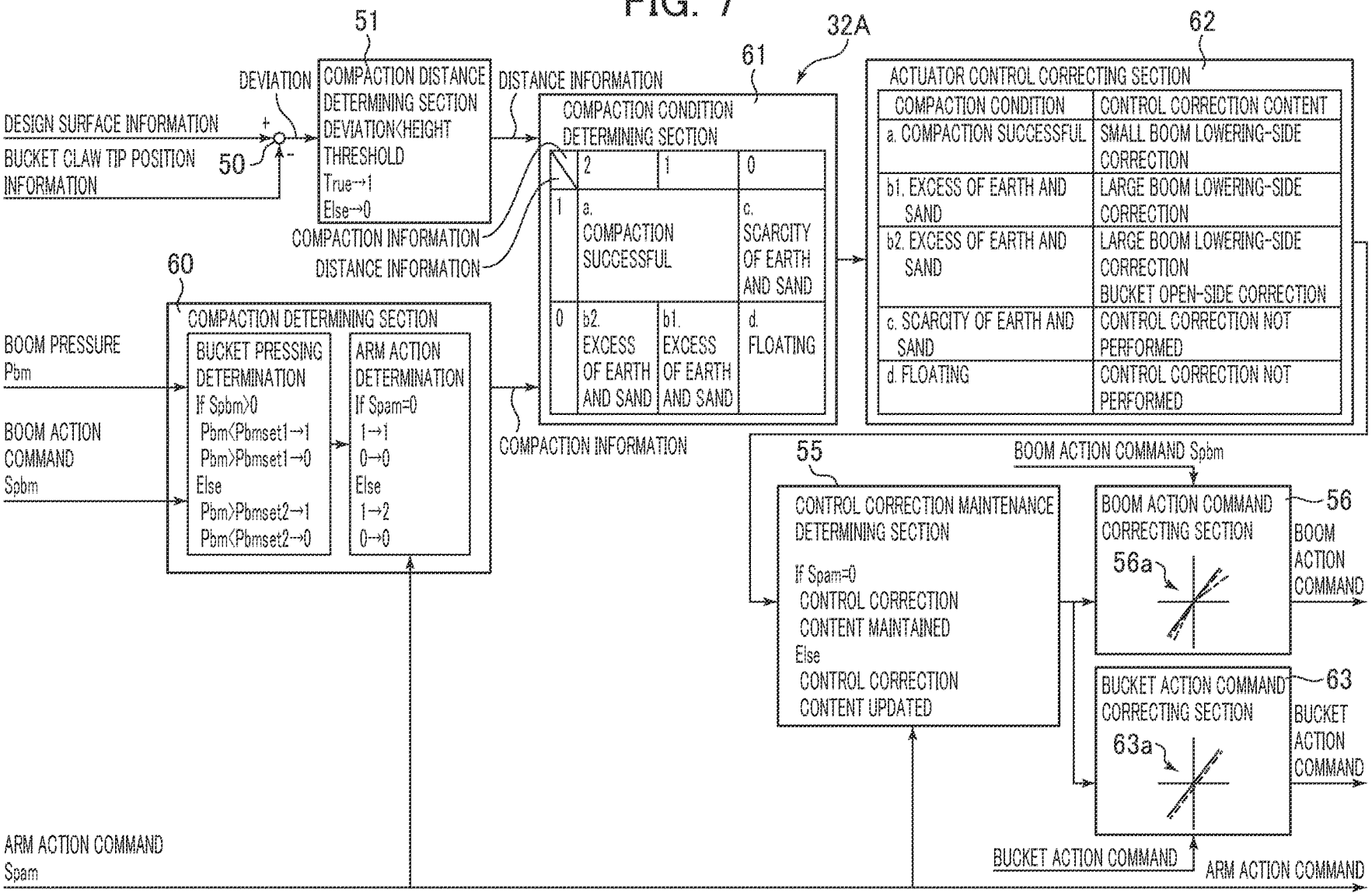
FIG. 7 is a functional block diagram of a compaction control section according to a second embodiment of the present invention.

FIG. 7 is a functional block diagram of a compaction control section according to the present embodiment. A compaction control section 32A according to the present embodiment includes a compaction determining section 60 instead of the compaction determining section 52 (illustrated in FIG. 4) according to the first embodiment, includes a compaction condition determining section 61 instead of the compaction condition determining section 53 (illustrated in FIG. 4) according to the first embodiment, includes an actuator control correcting section 62 instead of the actuator control correcting section 54 (illustrated in FIG. 4) according to the first embodiment, and further includes a bucket action command correcting section 63.

The compaction determining section 60 first performs bucket pressing determination based on the boom pressure Pbm, whether the boom action command Spbm is positive or negative, and the arm action command Spam, similar to the compaction determining section 52 (illustrated in FIG. 4) according to the first embodiment. Next, according to the arm action command Spam, the compaction determining section 60 changes a result of bucket pressing determination, and outputs the result to the compaction condition determining section 61 as compaction information. Specifically, the compaction determining section 60: outputs the result of the bucket pressing determination directly as the compaction information if the arm action command Spam is 0; outputs 2 as the compaction information if the arm action command Spam is not 0, and the result of the bucket pressing determination is 1; and outputs 0 as the compaction information if the arm action command Spam is not 0, and the result of the bucket pressing determination is 0.

The compaction condition determining section 61 determines a compaction condition based on the distance information from the compaction distance determining section 51 and the compaction information from the compaction determining section 60, and outputs a result of the determination about the compaction condition to the actuator control correcting section 62. Specifically, if the compaction information is 1 or 2, and the distance information is 1 (the bucket bottom surface is being pressed against the ground while the bucket claw tip position is close to the design surface), the compaction condition is determined as "a. Compaction Successful"; if the compaction information is 1, and the distance information is 0 (the bucket bottom surface is being pressed against the ground while the bucket claw tip position is away from the design surface, and it is expected the arm 6 is not to be in action), it is determined that compaction by bumping is not being performed successfully due to an excess of earth and sand ("b1. Excess of Earth and Sand"); if the compaction information is 0, and the distance information is 1 (the bucket bottom surface is not being pressed against the ground while the bucket claw tip position is close to the design surface), the compaction condition is determined as "c. Scarcity of Earth and Sand"; if the compaction information is 0, and the distance information is 0 (the bucket bottom surface is not being pressed against the ground while the bucket claw tip position is away from the design surface), the compaction condition is determined as "d. Floating"; and if the compaction information is 2, and the distance information is 0 (the bucket bottom surface is being pressed against the ground while the bucket claw tip position is away from the design surface, and it is expected that the arm is to be in action), the compaction condition is determined as "b2. Excess of Earth and Sand."

Based on the compaction condition from the compaction condition determining section 61, the actuator control correcting section 62 decides a control correction content, and outputs the control correction content to the control correction maintenance determining section 55. Here, processes to be performed if the compaction condition is "a. Compaction Successful," "c. Scarcity of Earth and Sand," or "d. Floating" are the same as those performed by the actuator control correcting section 54 (illustrated in FIG. 4) according to the first embodiment, and so the explanations are omitted. If the compaction condition is "b1. Excess of Earth and Sand," the bucket bottom surface is being pressed against the ground, but the bucket 7 is away from the design surface; therefore, correction is desirably performed to reduce the degree of rising of the boom 5 or increase the degree of lowering of the boom 5 in order to lower the bucket 7 a lot. Accordingly, a control correction content that the boom action command is corrected a lot toward the boom lowering-side (large boom lowering correction) is output. If the compaction condition is "b2. Excess of Earth and Sand," the bucket bottom surface is being pressed against the ground, but the bucket 7 is away from the design surface; therefore, correction is desirably performed to reduce the degree of rising of the boom 5 or increase the degree of lowering of the boom 5 in order to press the bucket 7 against the ground harder. Furthermore, since compaction is being performed while at the same time the arm 6 is moved, to excavate excess earth and sand by moving the bucket 7 toward the open-side is also effective for finishing the ground to form a surface as designed. Accordingly, a control correction content that the boom action command is corrected a lot toward the boom lowering-side, and the bucket is corrected toward the open-side (bucket open-side correction) is output.

Figure 8:
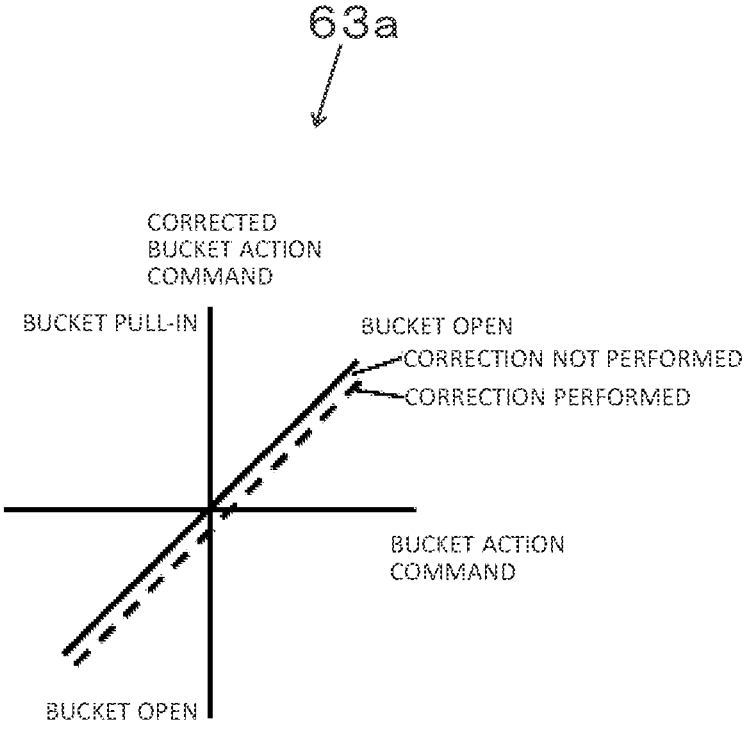
FIG. 8 is a drawing illustrating a bucket action command conversion table referred to by a bucket action command correcting section according to the second embodiment of the present invention.

The bucket action command correcting section 63 refers to a bucket action command conversion table 63*a* which is illustrated in FIG. 8 as an enlarged view, and corrects the bucket action command from the semi-automatic control section 31 according to the control correction content from the control correction maintenance determining section 55. Specifically, in the case of no bucket open-side correction, the bucket action command and the corrected bucket action command are related to each other at the ratio of 1:1 as indicated by the solid line in FIG. 8. In the case of bucket open-side correction, correction is performed such that the corrected bucket action command becomes smaller than the bucket action command as indicated by the dotted line in FIG. 8. By doing so, it is possible to excavate earth and sand while the bucket 7 is moved toward the open-side. In addition, since correction of the bucket action command is executed only if the arm action command Spam is not 0, the bucket 7 is never moved to the open-side unless compaction works to level the face of slope or the like by using the bucket 7 are being performed.

Figure 9:
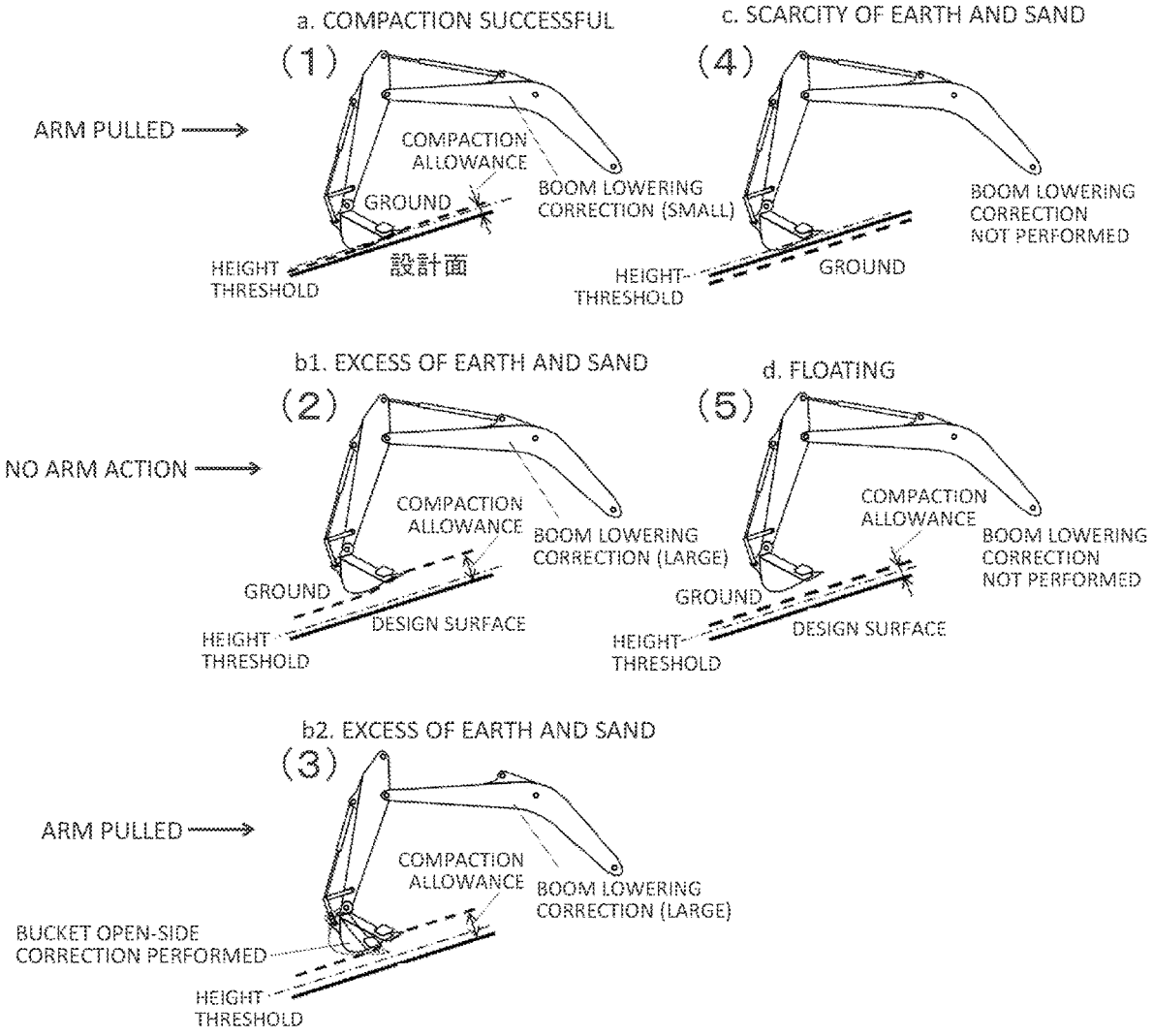
FIG. 9 is a drawing illustrating action of the front work implement at the time of compaction works according to the second embodiment of the present invention.

FIG. 9 is a drawing illustrating action of the front work implement 110 at the time of compaction works according to the present embodiment.

As illustrated in (1) of FIG. 9, when the deviation between the bucket claw tip position and the design surface is smaller than the height threshold, and arm-pulling action is being performed while the bucket bottom surface is being pressed against the ground, similar to the first embodiment (illustrated in (1) of FIG. 6), the compaction condition is determined as "a. Compaction Successful," and the boom action command is corrected a little toward the boom lowering-side; therefore, the force to press the bucket bottom surface against the ground increases a little, on the basis of the excessive excavation preventive action by the semi-automatic control section 31.

As illustrated in (2) of FIG. 9, when the deviation between the bucket claw tip position and the design surface is larger than the height threshold, and arm action is not being performed while the bucket bottom surface is being pressed against the ground, the compaction condition is determined as "b1. Excess of Earth and Sand," and the boom action command is corrected a lot toward the boom lowering-side; therefore, the force to press the bucket bottom surface against the ground increases a lot, on the basis of the excessive excavation preventive action by the semi-automatic control section 31.

As illustrated in (3) of FIG. 9, when the deviation between the bucket claw tip position and the design surface is smaller than the height threshold, and arm-pulling action is being performed while the bucket bottom surface is being pressed against the ground, the compaction condition is determined as "b2. Excess of Earth and Sand," the boom action command is corrected a lot toward the boom lowering-side, and additionally the bucket action command is corrected toward the bucket open-side; therefore, the force to press the bucket bottom surface against the ground increases a lot, and additionally the ground is excavated, on the basis of the excessive excavation preventive action by the semi-automatic control section 31.

As illustrated in (4) of FIG. 9, when the deviation between the bucket claw tip position and the design surface is smaller than the height threshold, and the bucket bottom surface is not being pressed against the ground, similar to the first embodiment (illustrated in (3) of FIG. 6), the compaction condition is determined as "c. Scarcity of Earth and Sand," and the boom action command is not corrected toward the boom lowering-side; therefore, excessive excavation preventive action by the semi-automatic control section 31 is prioritized.

As illustrated in (5) of FIG. 9, when the deviation between the bucket claw tip and the ground is larger than the height threshold, and the bucket bottom surface is not being pressed against the ground, similar to the first embodiment (illustrated in (4) of FIG. 6), the compaction condition is determined as "d. Floating," and the boom action command is not corrected toward the boom lowering-side; therefore, excessive excavation preventive action by the semi-automatic control section 31 is prioritized.

With the hydraulic excavator 100 according to the thus-configured present embodiment also, effects similar to those in the first embodiment can be obtained.

In addition, if compaction cannot be performed near the design surface due to an excess of earth and sand, and the arm 6 is in action, the boom action command is corrected a lot toward the boom lowering-side, and additionally the bucket action command is corrected toward the bucket open-side to thereby be able to excavate excess earth and sand while the bucket 7 is being pressed against the ground; therefore, it becomes possible to more efficiently perform leveling works.

Third Embodiment

A hydraulic excavator according to a third embodiment of the present invention are explained focusing on differences from the second embodiment.

Figure 10:
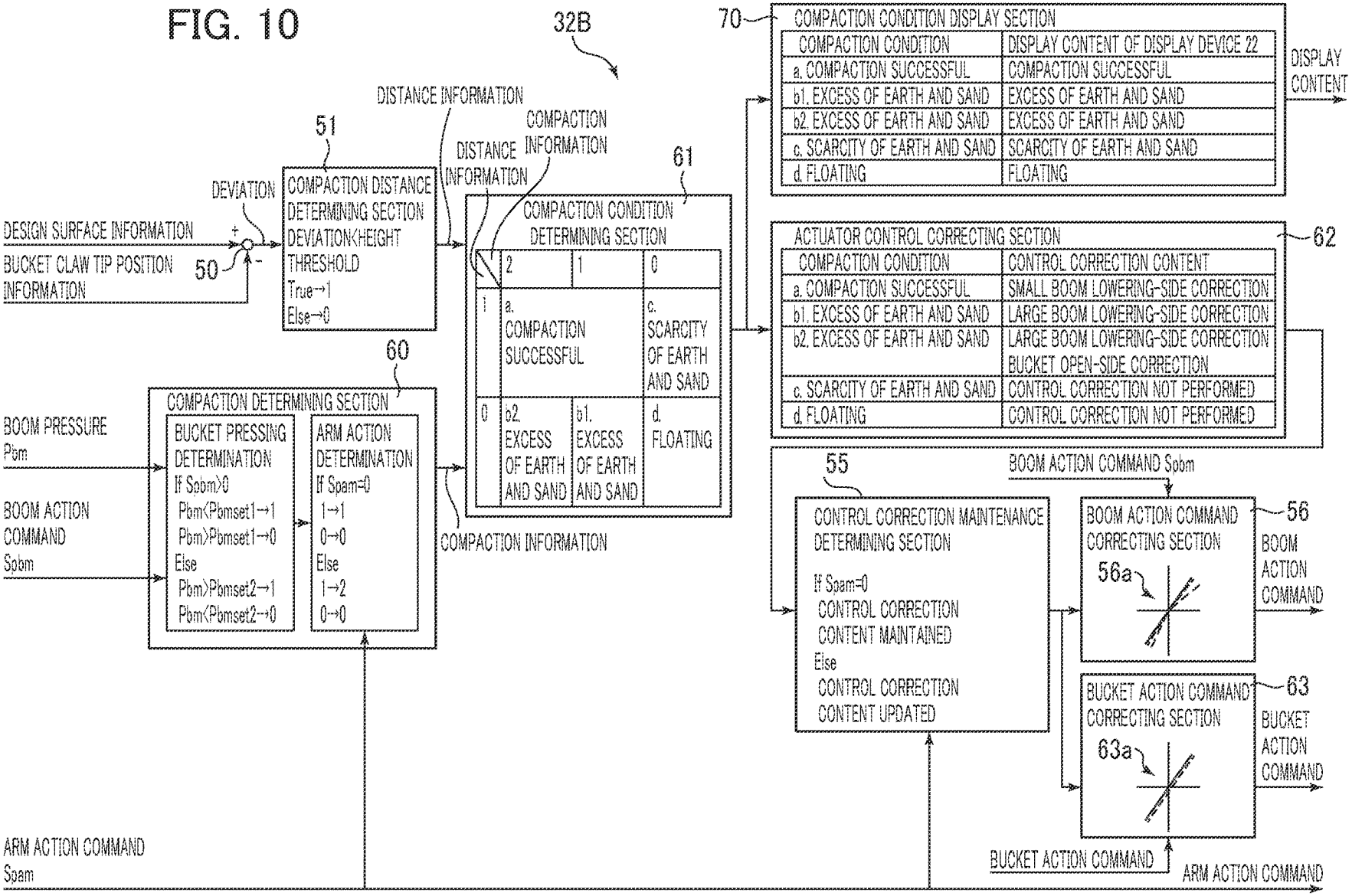
FIG. 10 is a functional block diagram of a compaction control section according to a third embodiment of the present invention.

FIG. 10 is a functional block diagram of a compaction control section according to the present embodiment. In FIG. 10, a compaction control section 32B according to the present embodiment further includes a compaction condition display section 70.

Based on the compaction condition from the compaction condition determining section 61, the compaction condition display section 70 decides a content (display content) to be displayed on the display device 22. Specifically, if the compaction condition is "a. Compaction Successful," the display content is "Compaction Successful"; if the compaction condition is "b1. Excess of Earth and Sand" or "b2. Excess of Earth and Sand," the display content is "Excess of Earth and Sand"; if the compaction condition is "c. Scarcity of Earth and Sand," the display content is "Scarcity of Earth and Sand"; and if the compaction condition is "d. Floating," the display content is "Floating."

With the hydraulic excavator 100 according to the thus-configured present embodiment also, effects similar to those in the second embodiment can be obtained.

In addition, by displaying the compaction condition on the display device 22, an operator can perform appropriate works according to the compaction condition. For example, if "Scarcity of Earth and Sand" is displayed on the display device 22, an operator can temporarily stop compaction works, and promptly take measures such as adding earth and sand to an area where they are needed.

Fourth Embodiment

A hydraulic excavator according to a fourth embodiment of the present invention are explained focusing on differences from the first embodiment.

Figure 11:
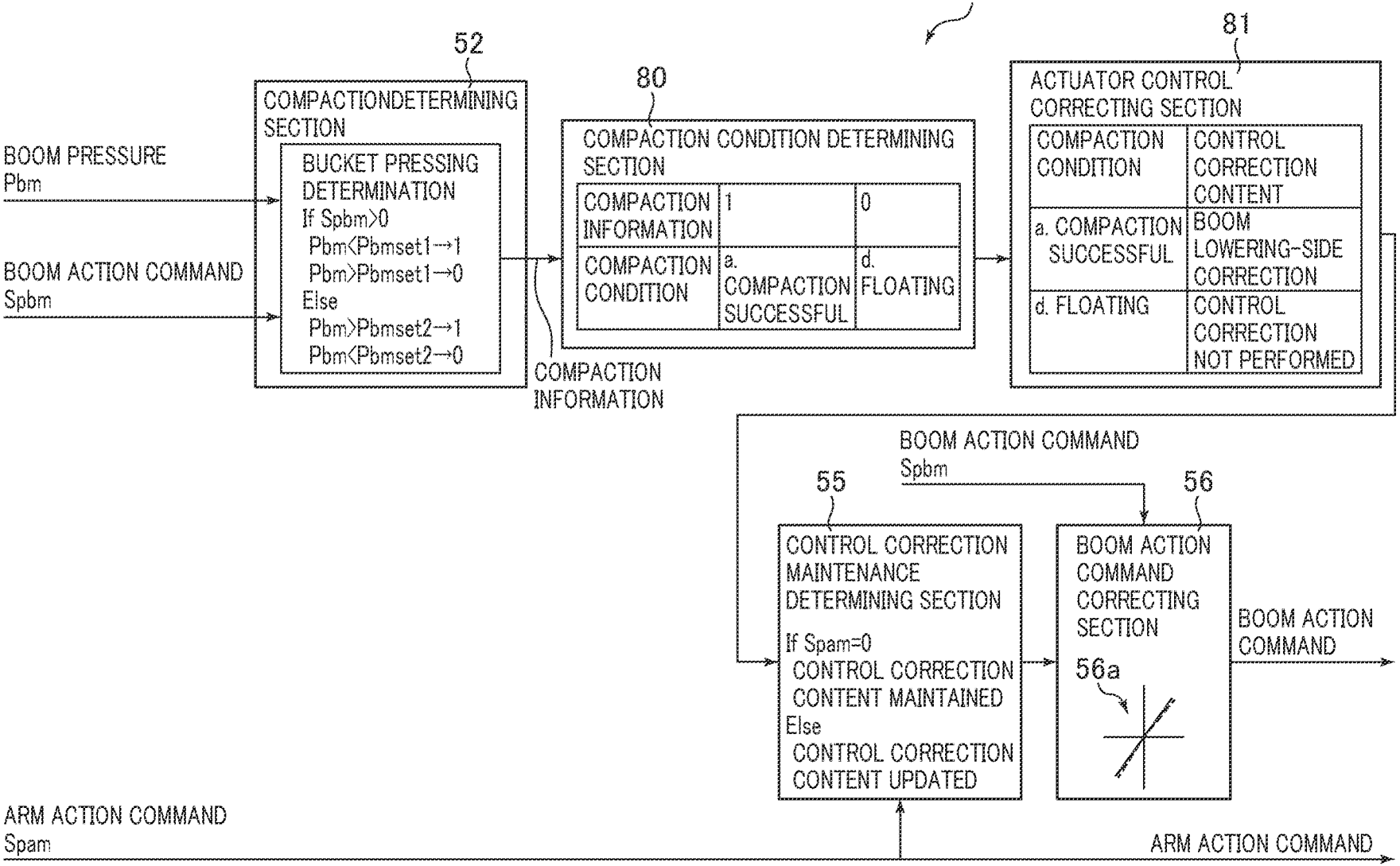
FIG. 11 is a functional block diagram of a compaction control section according to a fourth embodiment of the present invention.

FIG. 11 is a functional block diagram of a compaction control section according to the present embodiment. The compaction distance determining section 51 (illustrated in FIG. 4) according to the first embodiment is omitted in a compaction control section 32C according to the present embodiment, and the compaction control section 32C includes a compaction condition determining section 80 instead of the compaction condition determining section 53 according to the first embodiment, and includes an actuator control correcting section 81 instead of the actuator control correcting section 54 (illustrated in FIG. 4) according to the first embodiment.

The compaction condition determining section 80 determines the compaction condition based only on the compaction information from the compaction determining section 52. Specifically, the compaction condition determining section 80 determines that compaction is being performed successfully ("a. Compaction Successful") if the compaction information is 1 (the bucket bottom surface is being pressed against the ground), and determines that compaction is not being performed successfully ("d. Floating") if the compaction information is 0 (the bucket bottom surface is not being pressed against the ground).

Based on the compaction condition from the compaction condition determining section 80, the actuator control correcting section 81 decides a control correction content. Specifically, if the compaction condition is "a. Compaction Successful," correction is desirably performed to reduce the degree of rising of the boom 5 or increase the degree of lowering of the boom 5 in order to surely press the bucket 7 against the ground. Accordingly, a control correction content that the boom action command is corrected toward the boom lowering-side (boom lowering correction) is output. If the compaction condition is "d. Floating," control correction is not performed, but excessive excavation preventive control by the semi-automatic control section 31 is prioritized.

With the hydraulic excavator 100 according to the thus-configured present embodiment, when the bucket bottom surface is not being pressed against the ground, the lever operation amount is corrected by the semi-automatic control section 31 such that the bucket 7 does not penetrate down the design surface. On the other hand, when the bucket bottom surface is being pressed against the ground, the boom action command having been corrected by the semi-automatic control section 31 is corrected toward the boom lowering-side such that the force to press the bucket bottom surface against the ground increases. Thereby, it becomes possible to assist operator's operation in works to excavate the ground to form a surface as designed, and additionally to assist operator's operation in compaction works to compact the ground to form a surface as designed.

Although embodiments of the present invention are mentioned in detail thus far, the present invention is not limited to the embodiments explained above, but include various variants. For example, the embodiments explained above are explained in detail so as to explain the present invention in an easy-to-understand manner, and the present invention is not necessarily limited to embodiments including all the explained configurations. In addition, it is also possible to add some of configurations of an embodiment to configurations of another embodiment, and it is also possible to eliminate some of configurations of an embodiment, or to replace some of configurations of an embodiment with part of another embodiment.

DESCRIPTION OF REFERENCE CHARACTERS

1: Track structure
2: Swing structure
3: Counter weight
4: Cab
5: Boom
5*a*: Boom cylinder
6: Arm
6*a*: Arm cylinder
7: Bucket (work tool)
7*a*: Bucket cylinder
8: Swing device
8*a*: Swing motor
9: Pump device
10: Control valve unit
11: Bucket position measurement system
15L: Left operation lever device
15R: Right operation lever device
20: Controller
21: Design surface input device
22: Display device
23: Hydraulic device
24: Pressure sensor
30: Operator commanding section
31: Semi-automatic control section
32, 32A, 32B, 32C: Compaction control section
50: Adding/subtracting section
51: Compaction distance determining section
52: Compaction determining section
53, 80: Compaction condition determining section
54, 81: Actuator control correcting section
55: Control correction maintenance determining section
56: Boom action command correcting section
56*a*: Boom action command conversion table
60: Compaction determining section
61: Compaction condition determining section
62: Actuator control correcting section
63: Bucket action command correcting section
63*a*: Bucket action command conversion table
70: Compaction condition display section
100: Hydraulic excavator (work machine)
110: Front work implement
200: Hydraulic control system

The invention claimed is:

1. A work machine comprising:

a work implement having a bucket and a boom that raises and lowers the bucket;

a plurality of hydraulic actuators that drive the work implement;

an operation device that gives an instruction about an operation amount of the plurality of hydraulic actuators; and a controller that executes a semi-automatic control for an excavation work to excavate a ground with the bucket by correcting the operation amount indicated by the instruction given by the operation device, such that the bucket does not move down below a predetermined design surface, wherein the controller is configured to:

(A) make a compaction determination to determine whether or not a bottom surface of the bucket is being pressed against the ground, (a1) the compaction determination being that the bottom surface of the bucket is being pressed against the ground if a boom action command to give an instruction about an action direction of the boom is an instruction for a raising action of the boom and a load pressure of a boom cylinder that drives the boom is lower than a first pressure threshold, (a2) the compaction determination being that the bottom surface of the bucket is being pressed against the ground if the boom action command is an instruction for a lowering action of the boom and the load pressure of the boom cylinder is higher than a second pressure threshold different from the first pressure threshold, (a3) the compaction determination being that the bottom surface of the bucket is not being pressed against the ground if the boom action command is the instruction for the raising action of the boom and the load pressure of the boom cylinder is higher than the first pressure threshold, and (a4) the compaction determination being that the bottom surface of the bucket is not being pressed against the ground if the boom action command is the instruction for the lowering action of the boom and the load pressure of the boom cylinder is lower than the second pressure threshold;

(B) execute a compaction control for performing a compaction work to compact the ground by further correcting an operation amount of the boom cylinder, having been corrected by the semi-automatic control, toward a boom lowering side to an extent that the bucket does not move down below the predetermined design surface if it is determined in the compaction determination that the bottom surface of the bucket is being pressed against the ground and if a compaction allowance that is a distance between the bucket and the predetermined design surface is shorter than a predetermined threshold that is not zero;

(C) execute the compaction control by further correcting the operation amount of the boom cylinder, having been corrected by the semi-automatic control, to be larger toward the boom lowering side to the extent that the bucket does not move down below the predetermined design surface than in the case where the compaction allowance is shorter than the predetermined threshold if it is determined in the compaction determination that the bottom surface of the bucket is being pressed against the ground and if the compaction allowance is equal to or longer than the predetermined threshold; and (D) execute the semi-automatic control of the excavation work by the operation amount of the boom cylinder having been corrected for the semi-automatic control if it is determined in the compaction determination that the bottom surface of the bucket is not being pressed against the ground.

2. The work machine according to claim 1, wherein the work implement has an arm that moves the bucket forward and backward, the plurality of hydraulic actuators include an arm cylinder that drives the arm, the operation device includes an arm operation device that gives an instruction about an operation amount of the arm cylinder, and the controller is configured to:

(E) expect based on the operation amount of the arm cylinder whether or not a position at which the bucket contacts the ground changes;

(F) update a content of correction if the position at which the bucket contacts the ground is expected to change; and (G) maintain the content of correction if the position at which the bucket contacts the ground is expected not to change.

3. The work machine according to claim 1, further comprising a display device, wherein the controller is configured to output results of the compaction determination and the compaction distance determination to the display device.

* * * * *